United States Patent [19]

Tice

[11] 3,977,339

[45] Aug. 31, 1976

[54] PNEUMATIC NEEDLE POSITIONING APPARATUS FOR STITCHING MACHINES

[76] Inventor: William A. Tice, 3620 N. Fountaincrest Drive, Knoxville, Tenn. 37918

[22] Filed: Dec. 8, 1975

[21] Appl. No.: 638,706

Related U.S. Application Data

[63] Continuation-in-part of Ser. No. 504,324, Sept. 9, 1974, Pat. No. 3,924,553.

[52] U.S. Cl. ..... 112/219 B

[51] Int. Cl.[2] ..... D05B 69/22; D05B 65/02

[58] Field of Search ..... 112/219 B, 219 A, 219 R, 112/220, 67, 87, 220

[56] References Cited

UNITED STATES PATENTS

| | | | |
|---|---|---|---|
| 1,880,164 | 9/1932 | Whitehouse | 112/219 R |
| 3,592,153 | 7/1971 | Margereson | 112/219 B |

FOREIGN PATENTS OR APPLICATIONS

| | | | |
|---|---|---|---|
| 497,893 | 12/1938 | United Kingdom | 112/219 B |

*Primary Examiner*—H. Hampton Hunter
*Attorney, Agent, or Firm*—Fitch, Even, Tabin & Luedeka

[57] ABSTRACT

Improved apparatus for positioning the needle of a stitching machine in a preselected position along its reciprocatory path including a pneumatically powered positioning motor connected to the drive shaft for the needle, a source of pressurized fluid (preferably air), conduit means connecting the source of pressurized fluid to the positioning motor, normally closed valve means interposed in the conduit means, and control means also interposed in the conduit means at a location between the valve means and the positioning motor and adaptable to activate and deactivate the motor for positioning the needle. Apparatus is provided to enhance the reliability and speed of start-up of the positioning motor and to enhance the accuracy of the position of the needle relative to its desired position at the end of a positioning cycle.

9 Claims, 11 Drawing Figures

PNEUMATIC NEEDLE POSITIONING APPARATUS FOR STITCHING MACHINE

This application is a continuation-in-part of copending application Ser. No. 504,324, filed Sept. 9, 1974 now U.S. Pat. No. 3,924,553, dated Dec. 9, 1975, entitled: "Needle Positioning Apparatus for Stitching Machines."

This invention relates to stitching machines and more particularly to apparatus for positioning the reciprocatable needle of such machines in a predetermined position along the reciprocatory path.

It is well recognized in the industries which use stitching machines, particularly the garment industry, that there exists a need for apparatus associated with a stitching machine which will position the reciprocatory needle either in the work or out of the work upon the completion of a stitching operation. Such positioning of the needle at the end of a stitching operation has been performed heretofore by the operator turning a hand wheel to rotate the drive shaft for the needle to move the needle into or out of the work as desired. By way of example, if the work-piece is to be turned to change the direction of stitching, it is desired that the needle be stopped in the work. Contrariwise, if the work-piece is to be removed from the machine at the end of the stitching operation, it is desired that the needle be stopped in a position out of the work.

Numerous devices have been proposed for automatically positioning the needle of a stitching machine in a preselected position at the end of a stitching operation. These devices predominately have been of the electrical or electro-mechanical type. In most all instances, these devices have involved the use of a cam or its equivalent associated with the drive shaft for the needle and a cam-follower type machanism which halts the rotation of the needle drive shaft upon the needle achieving the desired position. Most generally, these prior art devices have each included an auxiliary motor which rotates the needle drive shaft after the main drive motor for the needle drive shaft has been stopped at the end of a stitching operation.

Despite the acknowledged advantages of a needle positioning apparatus, and despite the numerous attempts to accomplish the desired results, it is generally acknowledged in the industry that there are no needle positioning devices presently available that are satisfactory from either their operation and/or economic standpoints. Besetting these prior art needle position devices are the problems of complexity of design, difficulty of installation, and sensitivity to maladjustment, all of which contribute to relatively high initial cost and inordinate demands relating to maintenance of the devices after their installation. So far as is known to applicant, prior to applicant's invention as disclosed in his copending application U.S. Pat. No. 3,924,553, there has been no pneumatically operated needle positioning device.

Not only is it desired in the stitching industry that there be provided a pneumatically powered needle positioner, it is desired that such positioner function rapidly and accurately. It is common in the stitching industry to pay wages to operators on the basis of their work output as measured by the number of piece goods that the operator completes in a given period of time. Operators are commonly assigned minimum work quotas with a premium being paid for work completed in excess of such quota. These operators, therefore, desire stitching equipment that performs its function accurately and reliably. In the instance of needle positioners for stitching machines, it is desired that there be a minimum of time consumed during the positioning cycle, i.e., from the time the operator heels the stitching machine until the needle is positioned for the operator to commence a further work maneuver, which may be relocating a workpiece, removing a completed workpiece and inserting a new workpiece, etc. Applicant's copending application Ser. No. 504,324 (now Pat. No. 3,924,553), discloses a needle positioner for stitching machine that is relatively fast and reliable in its operation. The present disclosure provides for faster starting of the needle positioning function, for less time for completing a positioning cycle, and for more accurate positioning of the needle at the desired location along its reciprocatory path.

As concerns the accuracy of the position of the needle relative to its desired position at the end of a positioning operation, it has been recognized in the art that a few degrees of rotational movement of the drive shaft of the needle produces substantial distance of movement of the needle along its reciprocatory path so that as little as three to five degrees of inaccuracy in stopping the rotation of the drive shaft in a needle positioning operation can result in intolerable inaccuracies in the ultimate stopped position of the needle.

It is therefore an object of this invention to provide an improved apparatus for automatically positioning the needle of a stitching machine in a preselected position along its reciprocatory path following the cessation of a stitching operation. It is another object to provide an improved apparatus of the class described in which there is improved accuracy in the position of the needle along its reciprocatory path relative to the desired position of the needle upon completion of the positioning cycle. It is another object to provide an improved needle positioning apparatus in which there is a relatively shorter period of time consumed in the course of the positioning operation.

Other objects and advantages of this invention will be recognized from the following description, including the drawings, in which.

Figure 1:
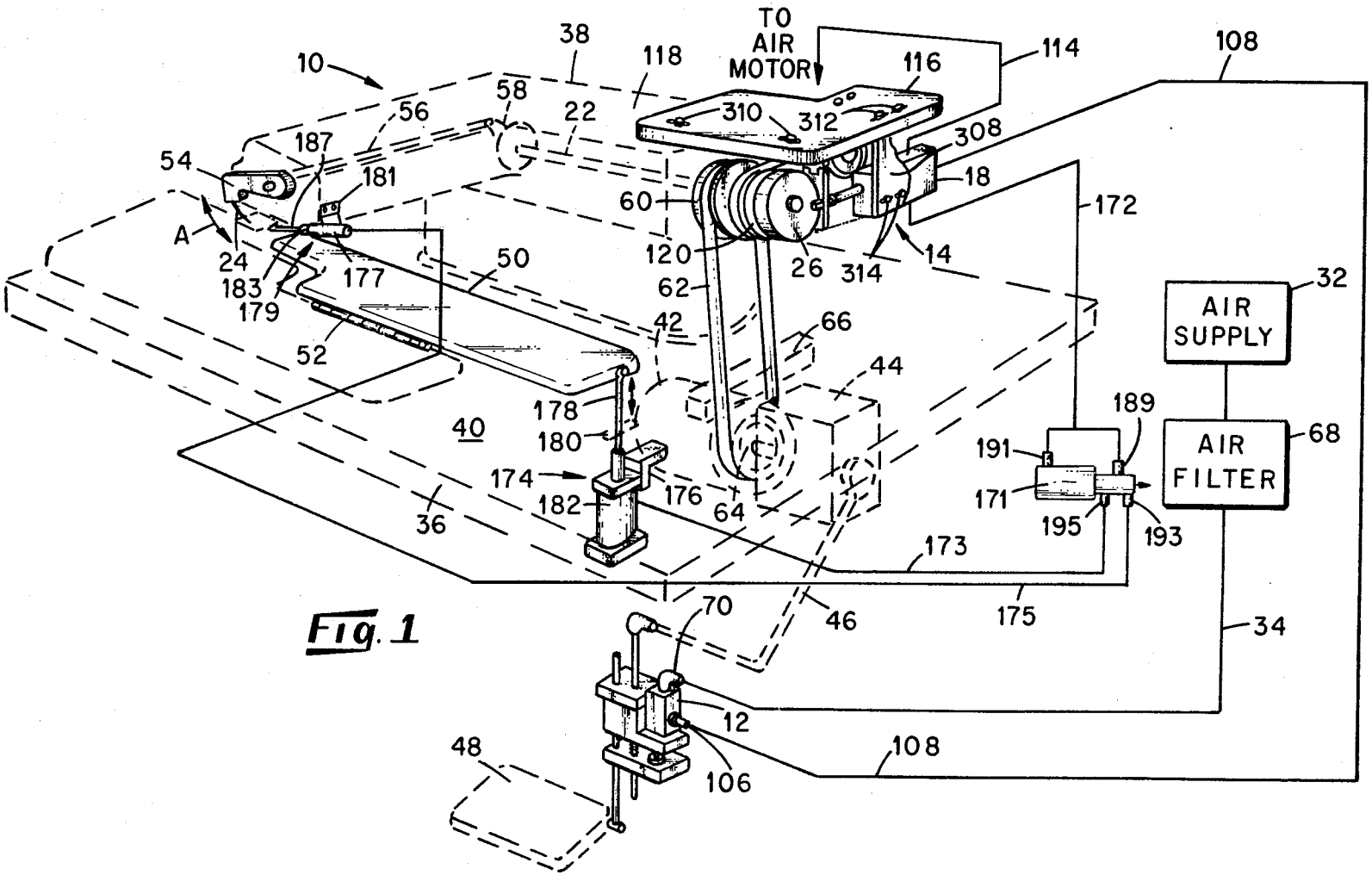
FIG. 1 is a representation of a stitching machine including apparatus depicting various features of the invention.

Briefly stated, the present invention comprises improved apparatus for positioning the needle of a stitching machine in a preselected position along its reciprocatory path including a pneumatically powered positioning motor connected to the drive shaft for the needle, a source of pressurized fluid, conduit means connecting the source of pressurized fluid to the positioning motor, valve means interposed in the conduit means, and control means also interposed in the conduit means at a location between the valve means and the positioning motor and adapted to activate and deactivate the motor for positioning the needle. The disclosed apparatus includes means for effecting relatively faster start-up of the positioning motor and a shorter time for completion of the positioning cycle, employing a given line pressure, which in the depicted embodiment comprises an in-line air flow throttle leading into a storage chamber having a volume sufficient to accumulate that quantity of pressurized fluid to start the positioning motor under load. Further, there is provided apparatus for relatively more accurately positioning the needle in the desired location along its reciprocatory path relative to the desired position, upon the cessation of a stitching operation. The depicted apparatus is fitted on a conventional stitching machine 10 and cooperates therewith such that when an operator stops the stitching machine upon the completion of a stitching operation, pressurized air, or its equivalent, is admitted through a normally closed valve 12 to a piston-cylinder control device 14. The position of the piston member 16 (FIG. 5) within the cylinder member 18 establishes the flow of pressurized air to a positioning air motor 20 (FIG. 3) that is drivingly connected to the drive shaft 22 for a reciprocatory needle 24. Cam means 26 fitted on the drive shaft 22 adjacent a detent means 28 provided on a cam follower means 29 interposed between the piston member 16 and the cam means 26 functions cooperatively with the piston member 16, the pressurized fluid and a biasing means, e.g. spring 30 (FIG. 5), to establish the position of the piston member within the cylinder member, hence to determine activation and deactivation of the air motor and to establish the position of the cam, the drive shaft and the needle in response to activation of the positioning apparatus by the operator.

With reference to FIG. 1, the depicted apparatus includes a source of pressurized fluid 32 connected through a conduit 34, the normally closed valve 12 and through a control system indicated generally at 14, to the air motor 20, which is drivingly connected to the drive shaft 22 whose rotation moves the needle 24 along its reciprocatory path.

In FIG. 1, there is depicted in phantom a stitching machine 10 including a table 36, a machine frame 38 mounted on the top surface 40 of the table, main drive motor means 42 mounted on the underside of the table, conventional clutch and brake means 44 also mounted on the underside of the table and including linkage means 46 operatively connecting the brake and clutch means to a treadle 48. The stitching machine further includes a work support 50 hingedly connected at 52 to the table 36 for movement in generally up and down directions to hold a workpiece in position beneath the needle 24 for performance of a stitching operation thereon. The needle 24, in the depicted embodiment, is mounted on an arm 54 for reciprocation along an arcuate path as indicated generally by the arrow A of FIG. 1. The arm 24 is reciprocated by means of a shaft 56 attached by a wobble mechanism 58 to the main drive shaft 22 of the machine. This main drive shaft 22 extends from the frame 38 to receive thereon a drive pulley 60 fixed on to the shaft 22 by an overriding clutch of conventional design. This drive pulley is drivingly connected by a belt 62 to a further pulley 64 mounted beneath the table 36 and operatively engageable with the motor 42 by a brake-clutch mechanism 44 for rotation of the drive shaft and reciprocation of the needle when the drive motor is engaged. The belt 62 passes upwardly through an opening 66 in the table 36.

Figure 2:
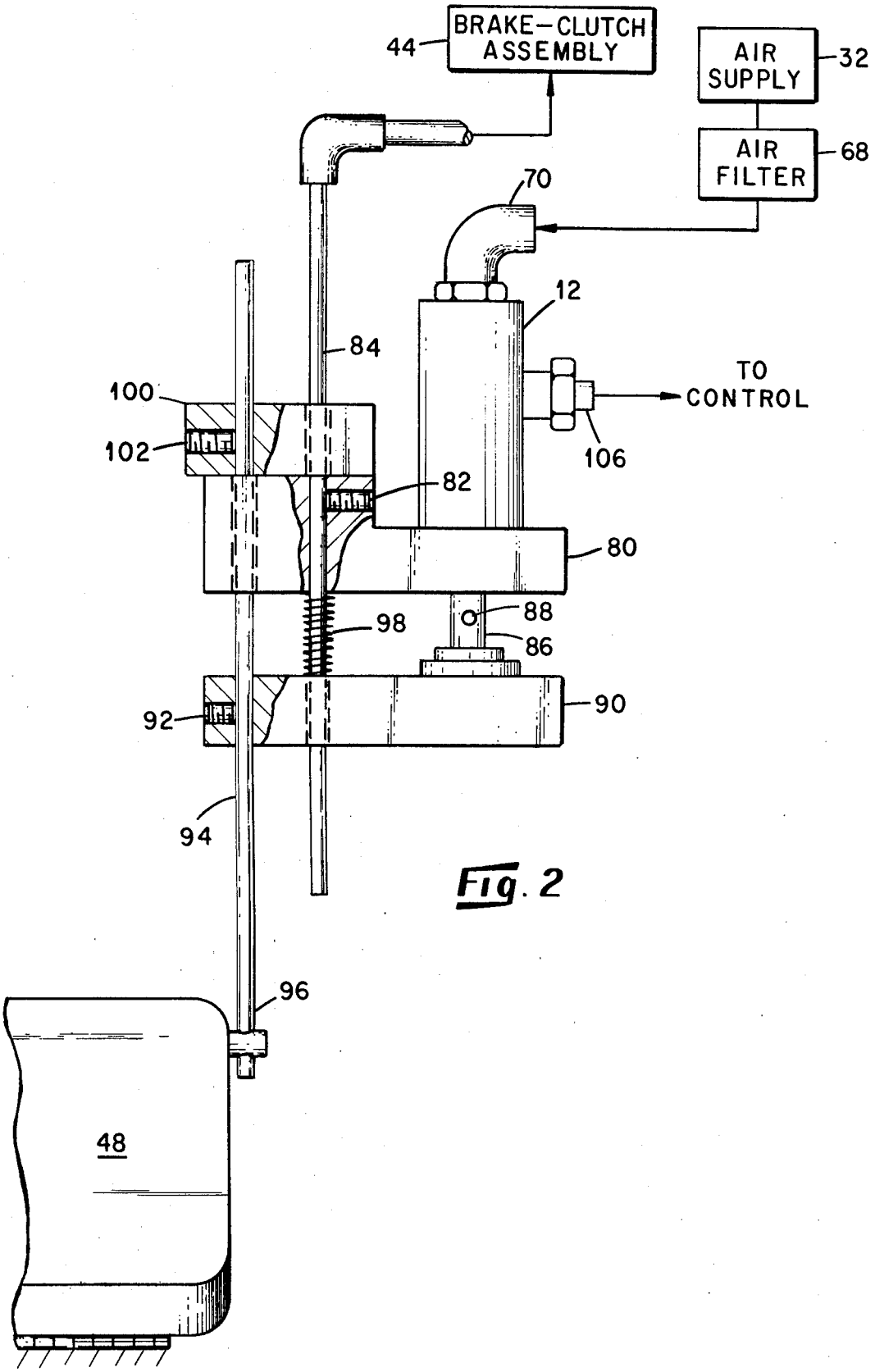
FIG. 2 is a representation of one embodiment of an operator control device for activating operation of the disclosed apparatus.

As noted above, the position of the needle 24 along its reciprocatory path is established by a pneumatically operated control system comprising a source of pressurized fluid 32, preferably air, which is fed through the conduit 34 and an air filter 68 to the inlet 70 of the normally closed valve 12 (FIGS. 1 and 2). One suitable valve comprises a Model MJV-3 valve available from the Clippard Valve Company, Cincinnati, Ohio. In the depicted embodiment this valve 12 is mounted on a first block 80 which is fixedly secured as by a set screw 82 to a first pitman rod 84 as will be referred to further hereinafter.

The valve 12, provided with a plunger 86 having an exhaust port 88 therein, is disposed adjacent a second block 90 that is fixedly secured as by a set screw 92 to a second pitman rod 94 connected at one of its ends 96 to the treadle 48 hingedly mounted for movement by an operator's foot, and extending upwardly therefrom. This second block 90 is disposed below the first block 80 and the pitman rods are in generally parallel alignment so that the vertical movement of the pitman rods relative to each other results in relative movement between the first and second blocks 80 and 90 and resultant opening and closing of the valve 12 by reason of the second block 90 operatively contacting the plunger 86 of the valve 12. The first and second blocks 80 and 90 are biased in spaced apart relation and toward a position of nonoperative engagement of the second block with the plunger 86 by a spring 98. The position of the second block 90 along the length of the second pitman rod 94 is chosen such that when the foot treadle 48 is in its up position, the block 90 will be either out of contact or in nonoperative contact with the plunger 86 of the valve 12 so that the valve remains closed. The second pitman rod 94 is provided with a further block 100 which is fixedly secured to the pitman rod as by a set screw 102. This further block is disposed above the first block 80 and functions to limit the upward travel of the first block 80 and thereby maintain the position of the plunger 86 with respect to the second block 90. Upon depression of the foot treadle, the second pitman rod is pulled downwardly causing the further block 100 to bear against the first block 80 and urge the plunger 86 of the valve 12 downwardly into operative engagement with the second block 90 to open the valve 12. Simultaneously, the depression of the foot pedal functions to also lower the first pitman rod 84 and activate the drive motor 42 as by the medium of the conventional brake and clutch mechanism 44. When the valve 12 is closed, pressurized fluid downstream thereof is exhausted through exhaust port 88 in the plunger 86.

The outlet 106 of the valve 12 is connected by a conduit 108 to an inlet 110 (FIG. 5) to the cylinder portion 18 of the piston-cylinder member 14. As depicted in FIGS. 1, 3, 5 and 6, the cylinder member 18 is provided with an outlet 112 that is connected by a conduit 114 to the air motor 20 mounted on the underside of a mounting plate 116 which is secured to the top surface 118 of the machine frame 38. The air motor 20 is drivingly connected to a pulley 120 fixed on the main drive shaft 22 employing a conventional overriding clutch of the type referred to hereinbefore, employing belt means 122 trained about a pulley 124 mounted on a shaft 126 mounted on a gear box 128.

Figure 3:
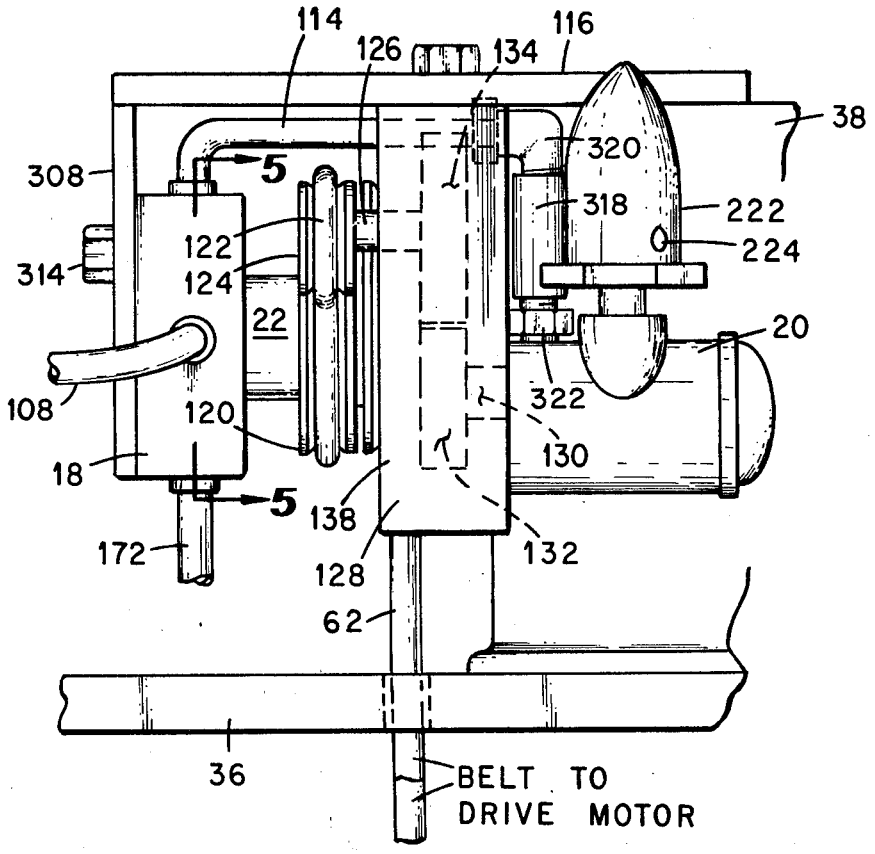
FIG. 3 is a rear elevational view of a portion of the disclosed apparatus including a positioning motor.

Referring to FIGS. 1 and 3, in one embodiment, the air motor 20 includes a shaft 130 fitted with a first gear 132. This first gear 132 meshes with a second gear 134 that is fitted on the shaft 126 journaled in the wall 138 of the gear box 128, and extending exteriorly thereof to receive the pulley 124 thereon. As noted, the pulley 124 is drivingly connected to the pulley 120 provided on the main drive shaft 22 of the stitching machine, as by a continuous loop belt 122 that is trained about these pulleys. By this apparatus, including the overriding clutch feature, of the pulley 120, the air motor functions to rotate the drive shaft 22 when the air motor is activated. The pulley 120 coasts when the air motor is inactivated and the main drive motor 42 is activated to perform a stitching operation.

Figure 5:
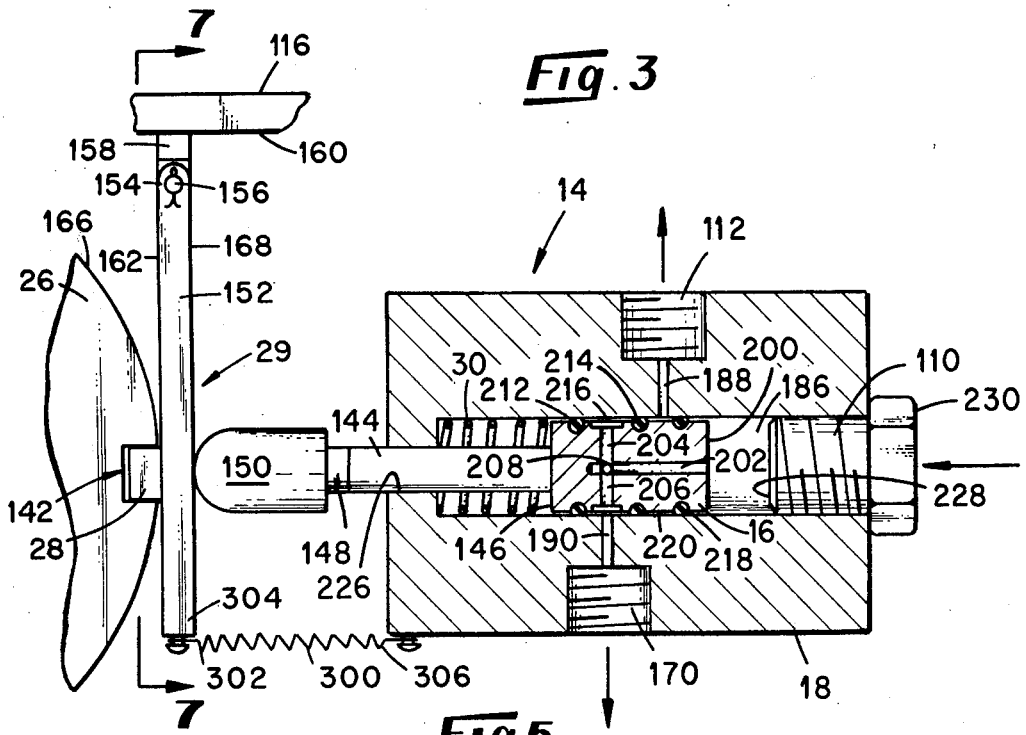
FIGS. 5 and 6 are sectional views, partly fragmentary, of a piston-cylinder, cam and cam follower, arrangements embodied in the disclosed apparatus.
Figure 7:
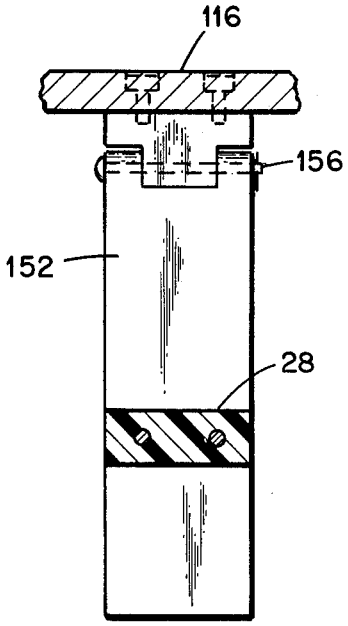
FIG. 7 is a view taken generally along the line 7—7 of FIG. 5.
Figure 4:
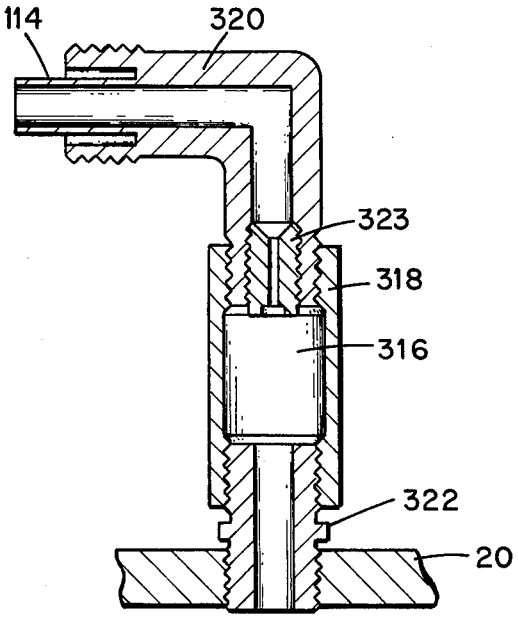
FIG. 4 is a sectional view, partly fragmentary, of a portion of the disclosed apparatus including a positioning motor.
Figure 8:
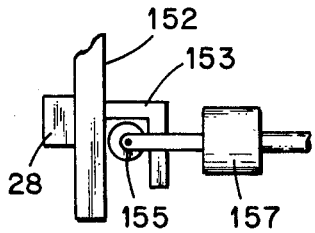
FIGS. 8–11 are fragmentary representations of alternative means for effecting simultaneously movement of the cam follower and the piston member of the piston-cylinder control means.
Figure 10:
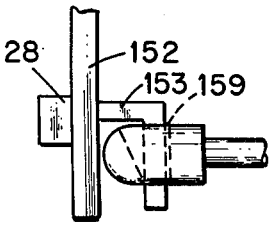
Figure 9:
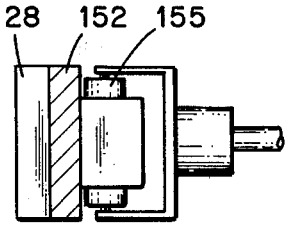
Figure 11:
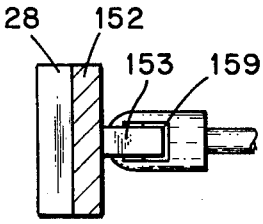

The main drive shaft 22 of the stitching machine is provided at its outboard end with the cam 26 which has a peripheral recess 142 therein. As seen in FIGS. 1 and 5, the piston-cylinder member 14 includes a piston member 16 having a rod 144 connected to one end 146 thereof. The opposite end 148 is threaded to receive a hub 150 of a low-friction material, such as polytetrafluoroethylene, to define a contact surface adapted to engage a cam follower means which in the depicted embodiment comprises an arm 152 that is hingedly mounted at one of its ends 154, by means of a pin 156, to a lug 158 depending from the bottom surface 160 of the mounting plate 116. The depicted arm 152 includes a first surface 162 to which there is mounted a detent 28 adapted to engage the peripheral surface 166 of the cam and enter the recess 142 at the appropriate time, and an opposite surface 168 facing the piston member 16 to be engaged by the hub 150 of such piston member. Importantly, the engagement of the hub 150 with the surface 168 of the arm is of a nature that provides for relatively free movement of the hub with respect to the surface 168 while providing for substantially simultaneous movement of the arm with, and in the same direction as, the movement of the piston 16. This is accomplished in one embodiment (see FIG. 5) by biasing the arm 152 in a direction toward engagement with the hub 150 by means of a coil spring 300 connected at one of its ends 302 to the outboard end 304 of the arm and at its opposite end 306 to the cylinder 18. Alternatively, the arm 152 may be provided with a projecting lug 153 that engages a roller 155 mounted on the externally exposed end 157 of the piston as shown in FIGS. 8 and 9 or engages an opening 159 provided in the end of the piston as shown in FIGS. 10 and 11.

It has been found by the present inventor that his invention as disclosed in the aforesaid application Ser. No. 504,324 (now Pat. No. 3,924,553) possesses a limitation in the speed at which the cam on the drive shaft can be rotated while still stopping the drive shaft reliably and accurately in a preselected position. This arises in part by reason of the detent, which is moved forwardly into the recess in the cam with a force and speed limited by the available line pressure and the need to oppose the biasing force for retracting the detent positively and rapidly, not entering the recess or incompletely entering the recess, such as stops the cam rotation, hence stops the drive shaft and needle precisely, if the cam is rotated too fast. This operational limitation tends to restrict or limit the maximum permissible speed of cam rotation and prevents shortening of the positioning cycle by speeding up the cam rotation. In addition, it has also been found that when the detent mounted on the outboard end of the extended piston engages the recess in the cam to stop the cam and drive shaft rotation, there is imparted to the piston, its rod, the mounting surfaces between the cylinder, piston and rod, along with the O-ring seals that surround the piston, a substantial shock force. This force has been found to potentially result in excessive wear at the surfaces of engagement between the cylinder and the piston, its rod and/or the O-rings. Furthermore, there is a tendency of the piston to become canted within the cylinder and resultant wedging of the piston against retractive movement when stitching is recommenced by the operator.

It is important, therefore, that there be freedom of movement of the end of the piston relative to the arm such that shock or stress forces experienced by the arm upon the detent engaging the recess in the cam are not transmitted to the piston to an appreciable degree. Especially, the engagement of the arm with the piston is of a type which imparts a minimum amount of force on the end 304 of the rod 152 that would tend to wedge or skew the piston 16 within the cylinder 18 or otherwise exert a moment on the rod that may cause the rod or piston to bind within the cylinder and inhibit free reciprocatory movement of the piston within the cylinder or to cause excessive wear on either the rod, the piston, the O-rings on the piston, the cylinder, or other bearing surface in the control unit. As seen in the Figures, the piston-cylinder member 14 is mounted on the underside of the mounting plate 116 to position the piston 16 relative to the cam follower. As shown in FIG. 1, the relative position of the mounting plate 116 with respect to the machine frame 38, the relative position of the piston-cylinder member 14 with respect to the mounting plate 116, and a mounting bracket 308 for the piston-cylinder are variable as by means of bolts 310, 312 and 314, which may be positioned at desired locations within respective elongated slots through which the bolts pass.

In the depicted embodiment, the piston-cylinder member 14 includes a second outlet 170 which is connected by a conduit 172 to a pulse valve 171, thence by a conduit 173 to the cylinder 182 of a second piston-cylinder means 174 mounted as by a bracket 176 on the underside of the table 36. The piston element 178 of the second piston-cylinder device passes upwardly through an opening 180 in the table to pivotally engage the hinged work support 50 such that retraction of the piston 178 into the cylinder 182 functions to lower the work support 50 and release a workpiece for removal from the stitching machine. The pulse valve 171 is further connected by a conduit 175 to the cylinder 177 of a thread cutter 179 that is mounted on the machine frame as by a bracket 181.

Referring to FIGS. 1, 3, and 5, the control system comprises the piston-cylinder member 14, the cylinder portion 18 of which is adjustably mounted on the lower side of the mounting plate 116, as noted above. Referring to FIG. 5, this cylinder member 18 is provided with a bore 186, the inlet end 110 of which is internally threaded for connection of the conduit 108 thereto. The cylinder is further provided with a lateral passageway 188 leading from the bore through the internally threaded outlet 112 to the exterior of the cylinder. In the depicted embodiment, the cylinder 18 is provided with a further lateral passageway 190 which leads from the bore to the exterior of the cylinder. Similarly, this passageway is provided with a threaded outlet 170 for connecting the conduit 172 thereto.

The piston 16 is slidably received within the bore 186 of the cylinder 18. This piston is biased as by the spring 30, toward the inlet end 110 of the bore 186. On that end of the piston opposite the inlet end to the cylinder, there is provided the rod 144 whose outboard end is provided with the hub 150 referred to above. This hub is positioned such that movement of the piston within the cylinder causes the hub to contact the cam follower to move the detent between positions of engagement and disengagement with the peripheral surface 166 of the cam 26 and in appropriate circumstances to enter the recess 142 in the cam periphery.

In accordance with the present invention, the movement of the piston 16 against the biasing force of the spring 30 is accomplished by applying pressurized fluid, air for example, through the inlet end of the cylinder 18 such that a force is exerted against the exposed end 200 of the piston 16 to urge the piston to the left as viewed in FIG. 5 to move the detent into engagement with the cam 26.

As seen in FIG. 5, the piston 16 is provided with an axial passageway 202 leading from the exposed end 200 of the piston inwardly of the piston. The piston is further provided with lateral passageways 204, 206, 208 and 210 (passageway 210 is not visible in the FIGS. but is located 180 degress from passageway 208), which communicate between the first passageway 202 and the exterior of the piston (hence communicating with bore 186 of the cylinder). Seal means, such as O rings 212 and 214, encircle the piston member at locations adjacent to and on opposite sides of the exit ports of the lateral passageways 204, 206, 208 and 210. In the depicted embodiment, the external diameter of the piston is reduced in the region between the seals 212 and 214 to define an annular cavity or chamber 216 between the piston and the internal wall of the bore 186. Further seal means such as O ring 218 is provided adjacent the exposed end of the piston and nearer such exposed end than the O ring 214, to define a blind annular cavity or chamber 220 between these O rings and between the piston and internal wall of the bore.

In one example of a piston-cylinder as depicted in FIG. 5, the bore 186 in the cylinder was 0.375 inch in diameter. The piston was 0.367 inch in diameter except that the diameter of the piston in the region between the O rings 212 and 214 was reduced to 0.0346 inch in diameter. In this example, the area of the exposed face of the piston was 0.947 inch$^2$, taking into consideration the cross-sectional area of the passageway 202, which was 0.011 inch$^2$. The cross-sectional area of each of the lateral passageways 204, 206, 208 and 210 was 0.0046 inch$^2$, or a total cross-sectional area of the four passageways of 0.018 inch$^2$. Under these conditions, employing an air pressure of 50 pounds per square inch applied through a one-fourth (¼) inch internal diameter conduit, there was an adequate supply of pressurized air supplied to the bore 186 to force sufficient air through the passageway 202 in the piston, thence out through the lateral passageways 204, 206, 208 and 210, thence through the annular cavity 216, thence through the lateral passageway 188 (0.00072 inch$^2$ cross-sectional area) in the housing, thence through the conduit 114 to the air motor 20, for example a GAST 1AM air motor as sold by Gast Manufacturing Corp., Benton Harbor, Michigan, to activate and drive the air motor for rotating the drive shaft 22 of a U.S. Blind Stitch Machine, Model No. 99 TT, for example. The air passing through the air motor was exhausted through a muffler 222 having an exhaust port 224.

It has been found that the positioning motor 20 may not function with 100% reliability with certain stitching machines, such as one that is worn, or that binds when its mechanism is oriented in a particular manner. All known air motors require a minimum volume of air at a given pressure to start the motor. This same volume and pressure will operate the motor at a specific number of revolutions per minute. It has been found further that when an air motor is used as the positioning motor, in many air motors, the motor operates too fast to permit accurate and reliable stopping of the motor at the end of its positioning run if the volume and pressure of the air supplied to the motor is raised to those values that are necessary to overcome the load and the starting inertia of the motor. This characteristic has been found to be present in the less expensive motors in particular so that more costly air motors or complicated air control systems may be required in the needle positioner for those stitching machines that present a substantial starting load to the motor. This has been found to be true even though the stitching machine only occasionally presents a too great starting load under the then existing conditions of air volume and pressure, such as may occur when some machines stop a stitching cycle in a bind.

In the depicted embodiment, the pressurized air exiting through the outlet 112 is fed to the motor 20 through an accumulating chamber 316 defined by a cylindrical nipple 318 having an internal diameter of about 0.5 inch and a length of about three-fourths inch. This nipple 318 is connected in the line 114 by fittings 320 and 322, the upstream one of which 320, is provided with a flow restrictive orifice device 323. The volume of the chamber 316, for example about 0.12 cubic inch, and the size of the orifice, for example 0.0400 inch diameter by 0.350 inch long, are such that when the line pressure is 50–60 pounds per square inch (psi) there will be sufficient and proper air flow to the motor to start it and thereafter rotate it at the desired rotational speed. The chamber 316 has been found to provide for accumulation of a substantial volume of air at a pressure equal to the pressure required to start the motor and to maintain its operation as further air is fed through the orifice and the chamber to the motor for continued operation at a reduced operational speed.

A further feature of the depicted apparatus includes the ability of the apparatus to automatically cut the thread at the needle 24 and lower the work support 50 (termed a frame in certain instances) upon completion of a stitching operation. This is accomplished by introducing, at the appropriate time in the operation of the machine, pressurized air to the cylinder 177 of the thread cutter 179 of conventional design to extend the piston 183 thereof to move a cutting knife 187 into severing engagement with the thread (not shown) and, thereafter, introducing pressurized air to the cylinder 182 mounted on the bracket 176 that is secured to the table 36 to retract the piston 178 into the cylinder 182 to swing the work support down against the force of a spring hinge 52 and out of its position of support for the workpiece. Movement of the piston 178 to its retracted position is accomplished by supplying pressurized fluid to the top end of the cylinder (as viewed in FIG. 1) via a conduit 173.

Referring to FIG. 5, it is seen that when the detent means 28 is disposed substantially within the recess 142 of the cam 26, the piston 16 is so positioned within the bore 186 of the cylinder 18 that the annular cavity 216 is disposed adjacent the lateral passageway 190 in the cylinder 18 and pressurized fluid flowing through the axial passageway 202 in the piston flows via conduit 172 to the dual inlets 189 and 191 of the pulse valve 171 (for example, a Model TAC 4P 34AR pulse valve as sold by Humphrey Products, Kalamzoo, Michigan). This valve 171 functions to initially pass the incoming pressurized air out through one of its outlets 193 and after a brief period of time to switch the air from the outlet 193 to a second outlet 195, while at the same time exhausting the pressure downstream to the outlet 193. In the depicted embodiment, the outlet 193 is connected by the conduit 175 to the thread cutter 171 so that initially upon the flow of pressurized air from the control 14 to the pulse valve 171, the air activates the thread cutter to sever the thread. Thereupon, sufficient time has elapsed for the pulse valve 171 to switch the air to the second outlet 195. This outlet 195 is connected via conduit 173 to the cylinder 182 so that the air acts to retract the piston 178 and lower the work support. Upon the switching by the valve 171, the air in the cylinder 177 of the thread cutter 179 exhausts through the valve 171 and allows the piston and the cutting knife to be retracted by a spring (not shown) within the cylinder 177 that biases the piston toward its retracted position. Upon the closing of the valve 12 by the operator working the treadle 48, the pressurized fluid within the cylinder 182 exhausts back through the valve 171 and the conduit 172 into the bore 186, thence through the conduit 108 and the exhaust port 88 of valve 12. After the pressurized fluid has exhausted, the work support moves to its up position under the influence of the spring hinge 52. Further, the piston 16, under the influence of spring 30, returns to its position adjacent the inlet end of the cylinder 18.

Figure 6:
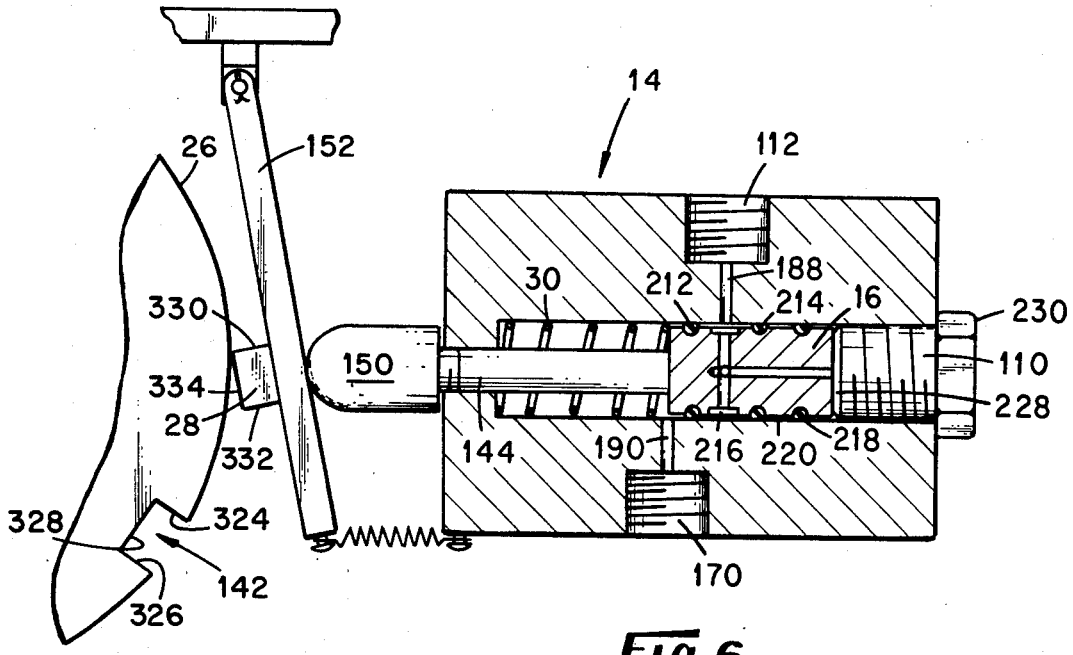

In the usual stitching machine, the main drive motor for the machine is activated and operates continuously. Engagement of the drive shaft for reciprocation of the needle is commonly accomplished by means of a conventional brake-clutch mechanism that is activated and/or deactivated by a foot treadle connected to the brake-clutch mechanism. The disclosed apparatus is inoperative at all times when the needle is being reciprocated by reason of the main drive motor being engaged, such inoperative status being assured by the aforedescribed normally closed valve 12 at all times during operation of the stitching machine. When the operator heels the foot treadle to disengage the main drive motor and stop the stitching operation, the plunger 86 of the normally closed valve 12 is moved to open the valve 12 and admit air to the inlet of the cylinder 18. FIG. 5 depicts the general position of the piston 16 within the cylinder 18 at this state of operation of the apparatus. It is to be recognized that the representations in FIGS. 5 and 6 are not to scale and the relative positions of the seals 212, 214 and 218 to one another and the position of the chamber 216 with respect to the passageway 188 are illustrative only. The pressurized air entering the cylinder 18 acts against the end 200 of the piston 16 to overcome the biasing force of the spring 30 to move the piston within the cylinder to a position such that the detent means 28 bears against the circumferential surface 166 of the cam 26. In the depicted embodiment, this movement of the piston is very slight and in any event is such that the annular cavity 216 is adjacent to and in communication with the lateral passageway 188 of the cylinder 18 so that substantially immediately upon the introduction of pressurized air to the inlet end of the cylinder 18, such pressurized air flows through the axial passageways of the piston, thence through the annular cavity 216, thence to the air motor 20 to activate this motor to rotate the drive shaft 22, hence rotate the cam 26. As the cam rotates, the detent 28 slides on the circumferential surface of the cam until the recess 142 in the cam surface comes into register with the detent, whereupon the detent moves into the recess by reason of the pressure applied to the exposed end 200 of the piston 16. This action not only applies a braking force to the cam against further rotation thereof, it also causes the piston 16 to move further into the bore 186 and position the annular cavity 216 out of communication with the lateral passageway 188 leading to the air motor and to position the blind annular cavity 220 adjacent such lateral passageway 188 to seal this passageway and deactivate the air motor 20. Of course, when the air motor 20 stops, the rotation of the drive shaft 22 by such motor, hence the rotation of the cam 26, stops.

In a preferred embodiment, the recess 142 in the cam surface is formed with opposite side walls 324 and 326 that are joined to one another by an end wall 328. The angle formed by the intersection of the end wall 328 with each of the side walls 324 and 326 is substantially equal to but not less than, ninety degrees. In similar manner, the detent in such preferred embodiment is formed with opposite side walls 330 and 332 that are joined by an end wall 334. The angle formed by the intersection of this end wall 334 and each of the side walls 332 and 334 is substantially equal to, but not less than, ninety degrees. The distance between the side walls 330 and 332 of the detent is slightly less than the distance between the side walls 324 and 326 of the recess so that the detent snugly engages the recess and positively and precisely stops the cam rotation at the desired location each time the detent enters the recess. The position of the detent relative to the machine frame is set by the length of the arm 152 and preferably is such that the detent is aligned with the horizontal diameter of the cam. The arcuate swing of the detent is relatively small so that the side walls of the detent and the recess are substantially parallel when the detent is urged into the recess. There is thus positive engagement of the recess by the detent and positive positioning of the cam, hence the needle, each time the apparatus functions.

In mounting the cam 26 on the drive shaft 22, the cam is rotated on the drive shaft and fixedly secured in a position such that when the needle is in its up position (for example), the recess 142 in the cam surface is in register with the detent 28. Thus, when the detent enters the recess and rotation of the cam and drive shaft 22 is stopped, the needle is stopped in its up position (out of the work). When it is desired to stop the needle in its down position, that is, in its position in the work, the cam only need be rotated 180° on the drive shaft 22 and fixed in such rotated position. Whereupon, when the recess comes into register with the detent, the needle will be stopped in its down position.

As depicted in the Figures and explained hereinbefore, the present apparatus also includes provision for cutting the thread and lowering the work support 50 of the stitching machine when the machine is stopped with the needle in the desired position and the detent resides in the recess of the cam. These features are advantageous in many stitching machines in that they enhance the speed with which the operator can remove a finished workpiece and insert a new workpiece.

When the operator desires to recommence a stitching operation, the foot treadle is depressed whereupon the second block 90 on the pitman rod 84 moves out of contact with the plunger 86 to close the valve 12 and shut off the pressurized air to the cylinder 18. Thereupon the biasing force of the spring 30 urges the piston 16 toward the inlet end 110 of the cylinder 18. Exhausting of the pressure in the cylinders 182 and 177 occurs as explained hereinabove. Upon movement of the piston 16 to its limit of travel adjacent the inlet end of the cylinder 18 and against one end 228 of a fitting 230 threaded in the inlet end of the cylinder 18, the annular cavity 216 again moves into communication with the lateral passageway 188 to permit exhausting of the pressurized fluid from the air motor through the cylinder 18 into the conduit 108, and eventually through the exhaust port 88 of the plunger 86. The apparatus thus is repositioned for reactivation upon the operator again heeling the foot treadle at the end of a stitching operation.

It is to be noted that in the present apparatus the interrelationship of the several components of the apparatus prevents activating the air motor, hence positioning of the needle, until the operator has stopped the stitching machine at the end of a stitching operation. This is assured by the use of the normally closed valve 12 and its physical relationship to the foot treadle 48. Further, the disclosed apparatus acts positively to perform its needle positioning function without malfunction by reason of the minimum number of moving parts included in the system. Similarly, installation of the apparatus on new or existing machines is simple. It is relatively inexpensive to manufacture and employs only pressurized air to operate, such being commonly available in manufacturing plants using stitching machines. Further, the apparatus is insensitive to maladjustment or deterioration by reason of the usual extended periods of continuous and demanding use to which stitching machines are commonly subjected.

Whereas, a specific embodiment of the apparatus and its operation have been disclosed, it is understood that other embodiments or equivalents will be apparent to one skilled in the art. For example, one can employ an electric drive motor connected directly (i.e., mechanically) to the needle drive shaft instead of the drive motor disclosed herein and its belt drive connection to the needle drive shaft.

Further, the valve 12 can be positioned adjacent the treadle 48 for opening and closing thereof by reason of its plunger 86 being contacted directly by the treadle. Still further, it is to be understood that the present apparatus is suitable for positioning the needle of many different machines and the depicted and described U.S. Blind Stitch machine is by way of example only.

What is claimed is:

1. In a stitching machine including a needle adapted for reciprocatory movement into and out of a workpiece, shaft means connected to said needle for reciprocating said needle upon rotation of said shaft, drive means including a drive motor for rotating said shaft, operator control means for activating and deactivating said drive means, the improvement for positioning said needle in a preselected position along its reciprocatory path comprising a pneumatically powered positioning motor, means connecting said positioning motor in driving relation to said shaft means for rotation of said shaft means when said drive motor is inactive, a source of pneumatic pressure, conduit means connecting said source of pneumatic pressure to said positioning motor, valve means interposed in said conduit means and actuatably responsive to functioning of said operator control means, control means interposed in said conduit means between said valve means and said positioning motor and operative when said valve means is open to activate said positioning motor to rotate said drive shaft to position said needle in a preselected position along its reciprocatory path, said control means comprising cylinder means having a bore extending therethrough, piston means disposed in said bore and having one of its ends exposed to said pressurized fluid when said valve means is open, the opposite end of said piston means being exposed externally of said cylinder means and defining a contact surface, cam means having a recess therein and mounted on said drive shaft in juxtaposition to said contact surface, cam follower means interposed between said contact surface and said cam means including detent means thereon in position to engage said cam means, means biasing said cam follower means out of contact with said cam means, means defining a passageway in said piston means from its exposed end to an exit location within said bore, seal means defining a plurality of chambers between said piston means and said cylinder means, at least one of said chambers communicating with said exit location of said passageway in said piston means, and means defining an exit passageway from said bore to the exterior of said cylinder means at a location contiguous to said chambers, whereby the position of said piston means within said bore establishes fluid communication between at least one of said chambers and said exit passageway to control the flow of pressurized fluid to said positioning motor.

2. The improvement of claim 1 wherein said cam follower means comprises an arm means hingedly mounted at one of its ends with its opposite end freely movably with respect to said contact surface of said externally exposed end of said piston means.

3. The improvement of claim 1 wherein said externally exposed end of said piston means is radiused to reduce the frictional engagement between said cam follower means and said end of said piston means.

4. The improvement of claim 1 wherein said cam follower means includes a first surface thereof facing said cam means and an opposite surface thereof facing said externally exposed end of said piston means, and detent means provided on said first surface in position to engage said recess in said cam means, said exposed end of said piston means being freely movable with respect to said opposite surface of said cam follower.

5. The improvement of claim 1 wherein said recess in said cam means includes opposite side walls and a bottom joining said side walls and the angle of intersection of each of said side walls and said bottom is substantially equal to, but not less than, ninety degrees, and said detent means comprises opposite side walls and an outboard end wall joining said side walls and the angle of intersection of each of said side walls with said bottom wall is substantially equal to, but not less than, 90°, and the distance between said side walls of said detent means is slightly less than the distance between said side walls of said recess whereby said detent is snugly received within said recess.

6. The improvement of claim 1 including means biasing said piston means within said cylinder means toward a position of disengagement with said cam follower means and biasing said cam follower means in the same direction as said piston means.

7. The improvement of claim 6 wherein said cam follower means is loosely connected with said exposed end of said piston means for substantially simultaneous movement of said cam follower means with said piston means.

8. The improvement of claim 1 including first spring means biasing said piston means in a direction away from said cam follower means, and further spring means biasing said cam follower toward said exposed end of said piston means and away from said cam means, the biasing force of said further spring means being small relative to the biasing force of said first spring means.

9. The improvement of claim 1 and including connector means interposed in said conduit means between said positioning motor and said control means and adjacent said positioning motor and defining chamber means, a flow restrictive orifice leading into said chamber means and regulating the flow of air through said conduit means to that value which will operate said positioning motor at a predetermined rotational speed but less than that air flow required to start said motor, the volume of said chamber being large enough to accumulate that quantity of air required to start said positioning motor under load.

* * * * *